US007841274B2

(12) United States Patent
Haller et al.

(10) Patent No.: US 7,841,274 B2
(45) Date of Patent: Nov. 30, 2010

(54) TRANSFER PRESS WITH NON-UNIFORM STATION SPACING

(75) Inventors: Dirk Haller, Göppingen (DE); Martin Schmeink, Salach (DE); Andreas Lauke, Gruibingen (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 330 days.

(21) Appl. No.: 12/075,901

(22) Filed: Mar. 14, 2008

(65) Prior Publication Data

US 2008/0264274 A1 Oct. 30, 2008

(30) Foreign Application Priority Data

Apr. 27, 2007 (DE) ..... 10 2007 019 899

(51) Int. Cl.
*B30B 15/30* (2006.01)
*B21D 43/10* (2006.01)

(52) U.S. Cl. ..... 100/207; 72/405.09; 72/405.1

(58) Field of Classification Search ..... 100/140, 100/207; 72/405.1, 405.2, 405.02, 405.09, 72/405.11, 405.12, 405.13, 405.16; 483/28, 483/29

See application file for complete search history.

(56) References Cited

U.S. PATENT DOCUMENTS 5,582,061 A * 12/1996 Harsch et al. ..... 72/405.1
5,584,205 A * 12/1996 Harsch et al. ..... 72/405.02
5,595,111 A * 1/1997 Michael et al. ..... 100/207

FOREIGN PATENT DOCUMENTS

| | | | |
|---|---|---|---|
| DE | 38 43 975 | C1 | 6/1990 |
| DE | 39 05 068 | C2 | 8/1990 |
| DE | 39 05 069 | C2 | 8/1990 |
| DE | 10 2004 015739 | A1 | 11/2005 |
| EP | 0 596 489 | B1 | 5/1994 |
| EP | 0 671 228 | A | 9/1995 |
| EP | 1 402 971 | A | 3/2004 |
| WO | WO 01/03891 | A1 | 1/2001 |

* cited by examiner

*Primary Examiner*—Jimmy T Nguyen
(74) *Attorney, Agent, or Firm*—R. S. Lombard; K. Bach

(57) ABSTRACT

In a press installation including a press with at least one press station and a multi-station press between arranged at a distance from each other which is a non-integral multiple of the press station distance of the multi-stage press. The installation also includes a transport arrangement for moving workpieces from press station to press-station concurrently by a step corresponding to the distance between the press station of the multi-station press. To compensate for an increased distance between the press station of the press and the adjacent press station of the multi-station press a deposit stage is arranged between the press and the multi-station press and includes a movable support an which the workpiece removed from the press can be deposited and from which, after appropriate movement of the support in the transport direction, it can be picked up by the transport arrangement for placement in the adjacent press station of the multi-stage press.

2 Claims, 1 Drawing Sheet

TRANSFER PRESS WITH NON-UNIFORM STATION SPACING

CROSS-REFERENCE TO RELATED APPLICATION

This application claims the priority benefits of German Application No. 10 2007 019 899.1 filed on Apr. 27, 2007.

BACKGROUND OF THE INVENTION

The invention resides in a press installation and, more distinctly, in a transfer press as it is used especially for the manufacture of large components, such as vehicle body parts.

Transfer presses include several press stages through which the workpiece passes in series. For the transport of the workpiece, a suction arrangement is provided which includes, for example, suction bridges by way of which the workpieces are transported from one press stage to another. The press stages are arranged in a predetermined pattern wherein the center distances between the press stages are all the same.

It is the object of the present invention to provide in connection with transfer press or similar press installations, a possibility for a more flexible arrangement while maintaining a uniform transfer.

SUMMARY OF THE INVENTION

In a press installation including a press with at least one press station and a multi-station press between arranged at a distance from each other which is a non-integral multiple of the press station distance of the multi-stage press. The installation also includes a transport arrangement for moving workpieces from press station to press-station concurrently by a step corresponding to the distance between the press station of the multi-station press. To compensate for an increased or reduced distance between the press station of the press and the adjacent press station of the multi-station press a deposit stage is arranged between the press and the multi-station press and includes a movable support an which the workpiece removed from the press can be deposited and from which, after appropriate movement of the support in the transport direction, it can be picked up by the transport arrangement for placement in the adjacent press station of the multi-stage press.

The press installation according to the invention includes at least one press with at least one press stage and at least one multi-stage press with two or several press stages. The press and the multi-station press may be parts of a transfer press or another press installation. Between the press and the multi-station press, there is a distance which is a non-integral multiple of the press-station distance. As distance, the distance between the centers of the tools is to be understood. In order to compensate for distance differences a deposit stage is arranged between the press and the multi-station press which is controllably movable in the transfer direction. The movement distance of the deposit stage is added to, or subtracted from, the length of the subsequent transfer steps and represents consequently the accurate press stage distance between the press and the multi-stage press.

The transfer arrangement is preferably so installed that its transfer step is uniform over the full length of the transfer arrangement and corresponds to the press-stage distance of the multi-station press.

Preferably, the gripper means of the transfer arrangement are maintained at distances which correspond to the distance between the press stages. The gripper means are preferably moved in a synchronous way. In the most simple case, they perform the same movement. The gripper means may, for example, be suction bridges which are attached to transfer rods. The transfer arrangement is preferably driven by way of NC-controlled, that is, numerical controlled, servomotors in horizontal directions, as well as in vertical lifting and lowering direction. By superposing the movements in transfer direction and in vertical direction, the desired transfer curves are obtained following which a sheet metal port is lifted out of a tool, transported to the next tool and deposited therein.

With this transfer movement, the workpiece or respectively sheet metal piece may also be deposited on the deposit stage, which then carries the sheet metal piece in the transfer direction from a first location to a second location where it is then picked up by the next gripper arm of the transfer arrangement for transferring it to the next work station. The deposit stage is preferably moved during a working stroke of the press and the multi-stage press. The movement of the deposit stage is preferably a drive linear movement. The movement is synchronized with the movement of the gripper means of the transfer arrangement.

Further features of advantageous embodiments of the invention will become more readily apparent by reference to the accompanying drawing.

DETAILED DESCRIPTION OF A PARTICULAR EMBODIMENT

Figure 1:
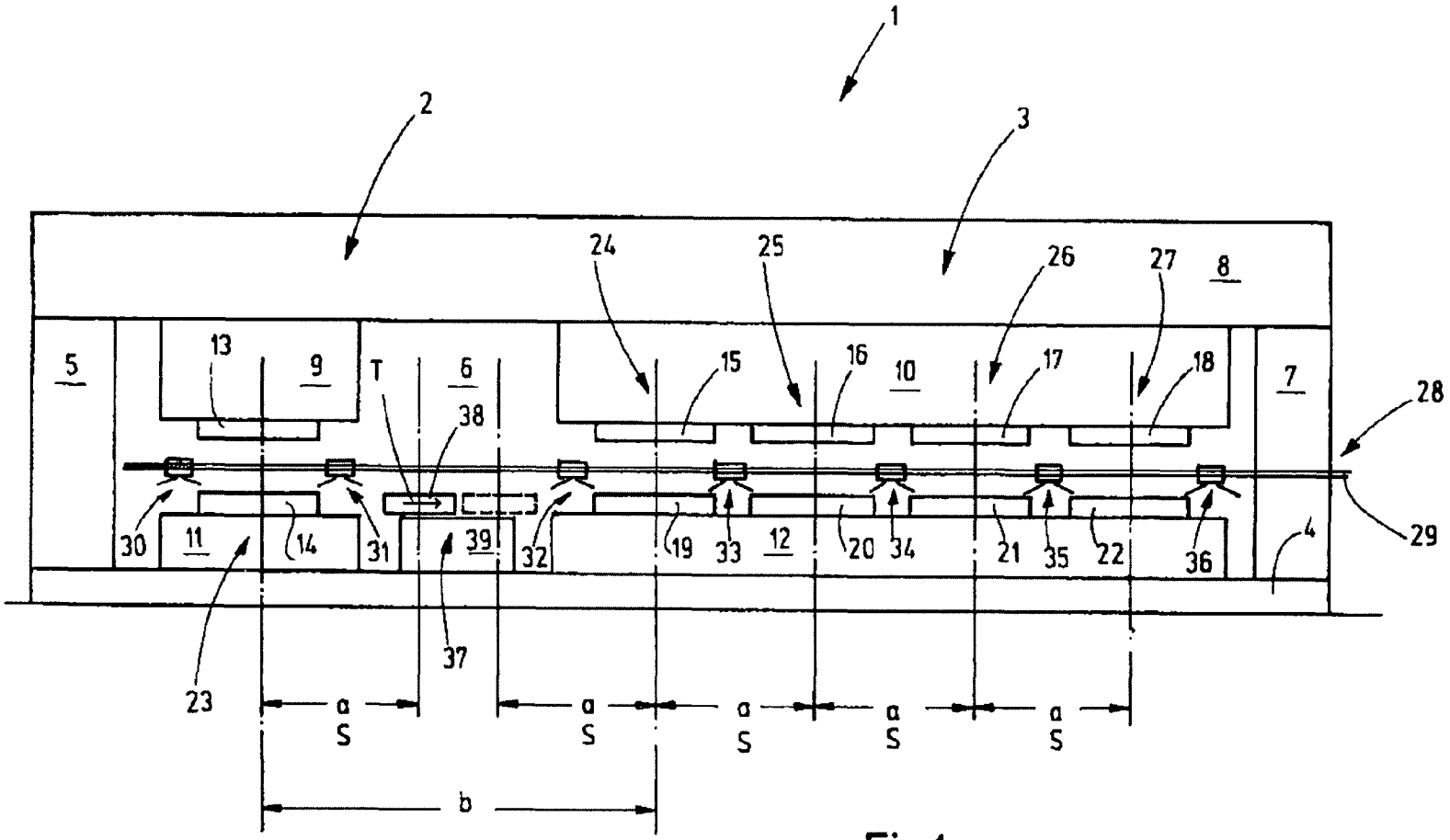
FIG. 1 shows a multi stage transfer press with non-uniform press-stage spacing in a schematic side view.

FIG. 1 shows a transfer press 1 which includes a press 2 in the form of a drawing press and a multi-station press 3. The press 2 and the multi-station press 3 have in the embodiment shown a common press frame which includes a press table 4, a press stand 5, 6, 7 and a head piece 8. The press stand 5, 6, 7 extends between the press table 4 and the head piece 8 and supports the head piece 8. In, or at, the head piece 8 a drive is provided for a slide 9 of the press 3 and also a drive for a slide 10 of the multi-station press 3, which drives however are not shown. The slides 9, 10 are vertically movably supported.

On the press table 4, or a corresponding other lower part of the press frame, slide tables 11, 12 are supported which are arranged below the slides 9, 10. In the press 2, a tool is arranged whose upper tool part 13 is connected to the slide 9 and whose lower tool part 14 is disposed on the slide table 11.

The slide 10 of the multi-station press 3 carries two or more, in the present embodiment four, upper tool parts 15, 16, 17, 18. The slide table 12 carries lower tool parts 19, 20, 21, 22 arranged under the respective lower tool parts 15, 16, 17, 18.

The tool parts 13 to 22 define the respective press stages that is a first press stage 23 for the press 2 and subsequent press stages 24, 25, 26, 27 for the multi-station press 3. The centers of the press stages 23 to 27 are indicated in FIG. 1 each by a dash-dotted vertical line.

The press stages 24 to 27 of the multi-station press 3 are uniformly spaced with a press stage distance a. The centers of the press stage 23 of the press 2 and the subsequent press stage 24 of the multi-stage press 3, however, are arranged at a distance b from each other which differs from press stage distance a, and which is not twice or three times, and is generally expressed, not as an integral multiple of the distance a.

The transfer press 1 includes a transfer arrangement 28 which comprises, for example, two transfer rails 29 extending longitudinally and horizontally over all the press stages 23 to 27. The transfer rails are arranged, for example, in parallel relationship in front of, and behind the tools as seen in FIG. 1. They may carry carriages which are inter-connected by suction bridges provided with suction devices 30 to 36 which can engage the metal sheet parts from above. The suction devices 30 to 36 form gripper means which, as shown in FIG. 1, are arranged at a uniform spacing as far as they are assigned to the press stages 24 to 27. These distances correspond to the distances a between the press stages 24 to 27. However, the gripper means 31, 32 which are arranged in the space between the press stages 23, 24 are arranged at a larger distance b-a (distance b-press center distance a) from each other.

Between the press 2 and the multi-station press 3, there is a deposit stage 37 which includes support 38 for the workpieces. The support 38 may comprise support elements which are adapted to the profile of the workpiece (metal sheet part) to be supported, so that the workpiece can be safely deposited on the support 38.

The deposit stage 37 includes a drive arrangement 39 which is shown in FIG. 1 only symbolically and by which the support 38 can be moved in the transfer direction T. The movement distance is at least b-2a.

The transfer press 1 described above works as follows:

In the transfer press 1 as shown in FIG. 1, the slides 9 and 10 of the press 2 and of the multi-station press 3 move synchronously up and down. Each time when the tools are open that is when the slides 9, 10 are at the upper of their movement curve the gripper means 31 to 36 move in a direction opposite to the transfer direction T into the open tools, that is in FIG. 1 toward the right, pick up the workpieces and move them in a flat arc to the tool of the next press stage and deposit them there and then return to their rest positions. Specifically, in the respective stages, the suction device 31 moves into the tool of the press stage 23, the suction device 33 into the tool of the press stage 24, the suction device 34 moves into the tool of the press stage 25 and so on.

While during the transfer process, the suction device 33 moves the workpiece out of the press stage 24 by a transfer step S, which corresponds to the distance a, into the tool of the press stage 25, the suction devices 31, 32 operate together with the deposit stage 37 to accomplish the workpiece transfer from the stage 23 to the stage 24. But also these suction devices are operated with the same transfer step S together with all the other suction devices.

In order to take over the workpiece from the suction device 31, the support 38 moves first into the position as shown in FIG. 1. In this position, the support 38 is disposed at a distance a from the center of the press stage 23. When the suction device 31 has been moved by its transfer of the length S, it is disposed over the support 38 and deposits the workpiece thereon. The suction devices are then moved back into their rest positions as shown in the FIGURE and the tools of the press stages 23 to 27 close in order to deform the workpieces in the desired way. At the same time, the support 38 moves in the transport direction into the position as shown in FIG. 1 in dashed lines where its center is disposed at a distance a from the center of the next press stage 24. When the tools are again opened, the transfer arrangement 28 is again activated: All suction devices 30 to 36 are moved again to the left in FIG. 1, so that the suction device 32 can pick up the workpiece from the support 38 disposed in the position indicated by dashed lines and can then move it into the press stage 24. As soon as the workpiece is picked up the support 38 returns to the left position shown in FIG. 1 in full lines in order to be properly positioned to accept the workpiece supplied by the suction device 31 from the press stage 23. This is then constantly repeated.

As apparent, the concept according to the invention using in connection with a different station distance or, respectively press stage distance an actively movable intermediate workpiece support permits a compensation for the different press stage distances while the transport devices for all the stages are moved in union by the same transport step length. The difference in distance between two press stages is compensated for by movement of the active workpiece support in the area between the press slides 9, 10. The transfer arrangement 28 transports the metal sheet from the last press stage 23 of the first slide 9 to the deposit stage 37. The active intermediate support 38 then moves the workpiece in transport direction so far that it can be moved by the transport arrangement 28 into the first press stage 24 of the next press slide 10 and be deposited therein. The active intermediate deposit stage 37 moves the workpiece by a programmable distance in transport direction and thereby facilitates the use of constant and equal transfer steps S even with different press stage distances which are not an integral multiple of the transport step S.

What is claimed is:

1. A transfer press (1) particularly for the manufacture of vehicle body parts comprising:

at least one press (2) with at least one press stage (23);

at least one multi-station press (3), which includes at least two press stages (24, 25) arranged at a predetermined distance (a) from one another;

the press stages (23) of the press (2) being arranged at a distance (b) from the subsequent press stage (24) of the multi-station press (3) which is a non-integral multiple of the press stage distance (a) between the press stages of the multi-station press (3);

a transport arrangement (28) extending through all the press stages (23-27) of the press (2) and of the multi-station press (3) in a transfer direction (T) and which includes workpiece gripper means (30-36) for gripping workpieces and moving them concurrently by steps (S) of the same length, and a deposit stage (37) arranged between the press (2) and the multi-station press (3) which is controllably movable in the transfer direction (T) in order to compensate for deviations between the distance (b) between the adjacent press stages (23, 24) of the press (2) and the multi-station press (3) and the transfer steps (S) of the transfer arrangement (28);

the deposit stage (37) comprises a support (38) on which the workpiece can be deposited and a drive arrangement (39) for moving the support (38); and, the drive arrangement (39) is adapted to move the support (38) linearly in the transport direction.

2. A transfer press (1) particularly for the manufacture of vehicle body parts comprising:

at least one press (2) with at least one press stage (23);

at least one multi-station press (3), which includes at least two press stages (24, 25) arranged at a predetermined distance (a) from one another;

the press stages (23) of the press (2) being arranged at a distance (b) from the subsequent press stage (24) of the multi-station press (3) which is a non-integral multiple of the press stage distance (a) between the press stages of the multi-station press (3);

a transport arrangement (28) extending through all the press stages (23-27) of the press (2) and of the multi-station press (3) in a transfer direction (T) and which includes workpiece gripper means (30-36) for gripping workpieces and moving them concurrently by steps (S)

of the same length, and a deposit stage (37) arranged between the press (2) and the multi-station press (3) which is controllably movable in the transfer direction (T) in order to compensate for deviations between the distance (b) between the adjacent press stages (23, 24) of the press (2) and the multi-station press (3) and the transfer steps (S) of the transfer arrangement (28);

the deposit stage (37) comprises a support (38) on which the workpiece can be deposited and a drive arrangement (39) for moving the support (38); and, the drive arrangement (39) is synchronized with the movement of the transport arrangement (28).

* * * * *